United States Patent [19]

Peterson

[11] 4,131,045

[45] Dec. 26, 1978

[54] METHOD AND APPARATUS FOR ACCELERATING A FILAMENT AND THE LIKE

[76] Inventor: Dennis R. Peterson, P.O. Box 1090, Los Alamos, N. Mex. 87544

[21] Appl. No.: 789,352

[22] Filed: Apr. 20, 1977

[51] Int. Cl.[2] ..... B26D 1/12; B26D 1/48

[52] U.S. Cl. ..... 83/403; 30/276; 56/12.7; 56/295

[58] Field of Search ..... 56/12.7, 295; 83/403; 30/276

[56] References Cited

U.S. PATENT DOCUMENTS

| | | | |
|---|---|---|---|
| 3,826,068 | 7/1974 | Ballas et al. | 56/12.7 |
| 3,928,911 | 12/1975 | Pittinger, Jr. | 56/12.7 X |
| 4,047,455 | 9/1977 | Pittinger, Sr. | 56/295 X |

*Primary Examiner*—Willie G. Abercrombie

*Attorney, Agent, or Firm*—Ancel W. Lewis, Jr.

[57] ABSTRACT

A method of and apparatus for accelerating a filament wherein an impelling force is applied to a length of filament a torque arm distance from an axis of rotation to rotate the length of filament about the axis of rotation thereby developing a tip speed that is of sufficient velocity for using the tip portion to cut a workpiece and, alternatively, to sequentially release the moving tip portion to discharge a series of particles for performing welding, drilling, coating, cutting and like operations. The length of filament, preferably, is the end section of a coil of filament and is simultaneously advanced along the longitudinal axis of the length of filament toward the tip portion during the application of said impelling forces. The advancement of the filament is controlled. The enclosure of the filament in an evacuated space increases the speed range.

18 Claims, 12 Drawing Figures

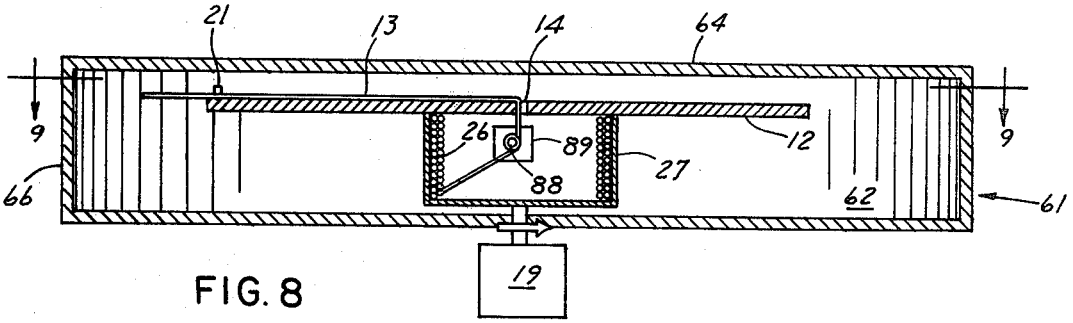
FIG. 8
FIG. 9
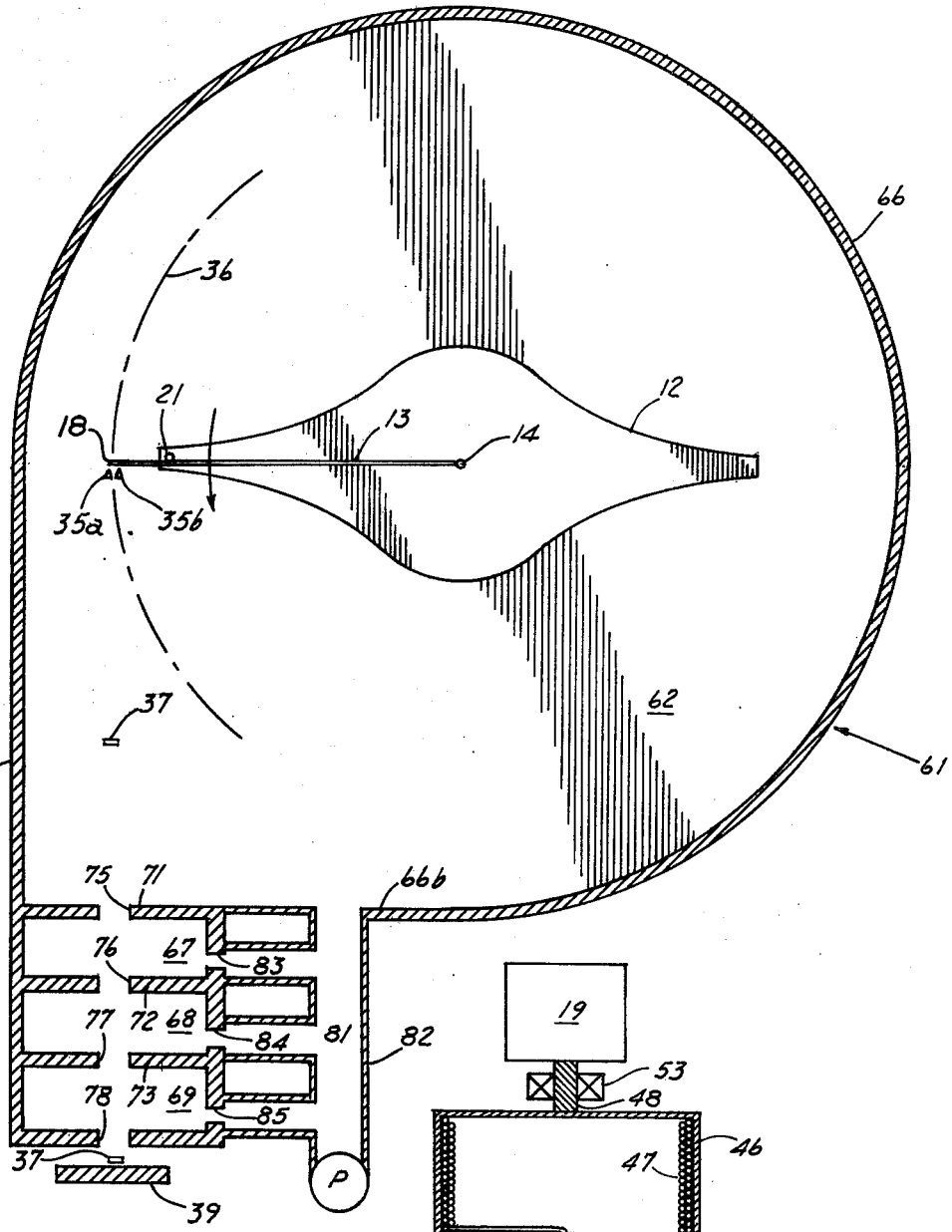
FIG. 7
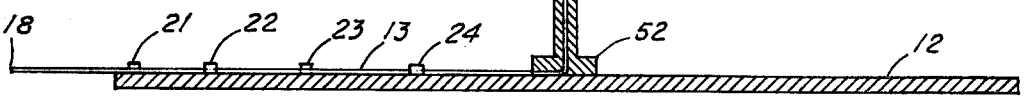

METHOD AND APPARATUS FOR ACCELERATING A FILAMENT AND THE LIKE

FIELD OF THE INVENTION

This invention relates generally to accelerating a filament and the like and more particularly to accelerating a filament to a speed that makes the moving filament suitable for a variety of useful purposes.

BACKGROUND OF THE INVENTION

There have been a number of methods and apparatus heretofore employed, including the light gas gun, shaped explosive charges, and the electrostatic accelerator to accelerate particles to high speeds. These practices typically involve micron size and larger particles and speeds ranging into the tens of kilometers per second. There are, however, disadvantages in using these prior known techniques and none is particularly effective for the rapid production of a steady stream of relatively small high-speed particles.

Accordingly, it is an object of the present invention to provide a relatively simple and highly effective method and apparatus for accelerating a filament for a number of useful purposes.

Another object of the present invention is to provide a novel method and apparatus for accelerating a filament that is particularly useful in cutting a workpiece.

Yet another object of the present invention is to provide a novel method and apparatus for accelerating a filament that is particularly suited for the rapid production of a steady stream of particles for cutting, coating, welding and like useful purposes.

Still another object of the present invention is to provide a novel method and apparatus suitable for producing ultra-high velocity, micron-size particles characterized by the application of an impelling force to a length of filament a torque arm distance from an axis of rotation and preferably in an evacuated space for increased speeds.

SUMMARY OF THE INVENTION

In a method and apparatus for accelerating a filament extremely high tip speeds are developed in the tip portion of a length of filament while the filament is advanced toward that tip portion. The length of filament is carried by a rotary member with a filament contacting portion a torque arm distance from the axis of rotation, and the centrifugal forces produced in the length of filament cause it to advance from a supply such as a coil in a support body that rotates with the rotary member. Various means are provided for controlling the advancement of the filament during rotation. For a cutting operation, a workpiece is placed in the path of the tip portion of the moving filament and preferably is advanced radially at a controlled rate to gradually cut the workpiece. The tip portion of the moving filament while being advanced along its longitudinal axis toward the tip is also periodically released as high-speed particles by one of several cutting techniques. The high-speed particles so produced are cut so as to be directed toward a work-piece for performing welding, cutting, drilling, coating and like operations on that workpiece. The enclosure of the filament and rotary member in an evacuated space facilitates the rotation of the rotary member at speeds sufficiently high to produce ultra-high speed micron-size particles and the like.

Other objects, advantages and capabilities of the present invention will become more apparent as the description proceeds taken in conjunction with the accompanying drawings, in which like parts have similar reference numerals and in which:

FIG. 7 is an elevational view of yet another form of high-speed filament accelerating apparatus with all portions except the drive motor shown in vertical section;

FIG. 8 is a vertical sectional view of an ultra-high velocity filament accelerating apparatus with the section through the rotary member offset from the longitudinal center line to the extent necessary to show the upstanding peg-like members in full;

FIG. 9 is a sectional view taken along lines 9—9 of the apparatus shown in FIG. 8;

DESCRIPTION OF THE PREFERRED EMBODIMENTS

Figure 1:
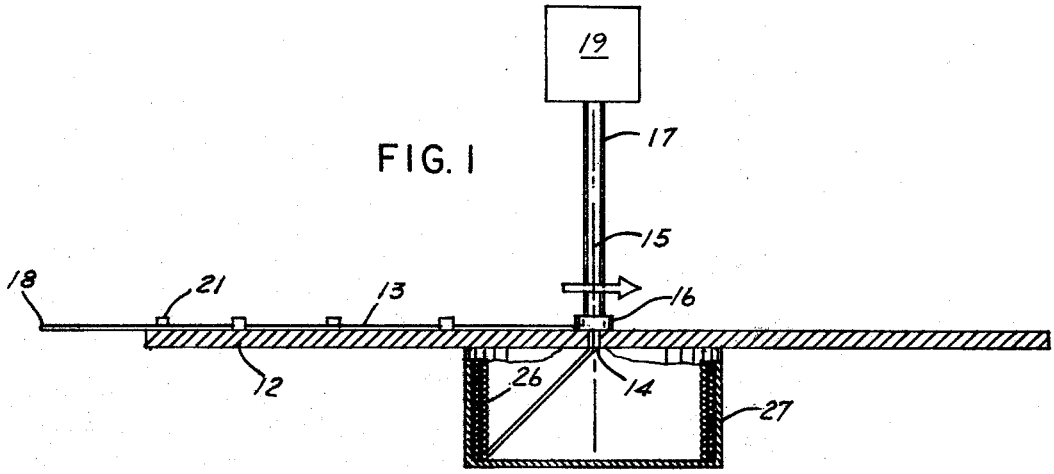
FIG. 1 is a side elevational view of high velocity filament accelerating apparatus embodying features of the present invention with the rotary member shown in section offset from the longitudinal center line to the extent necessary to show the upstanding peg-like members and filament in full and with portions of the support body broken away to show the coil of filament therein.
Figure 2:
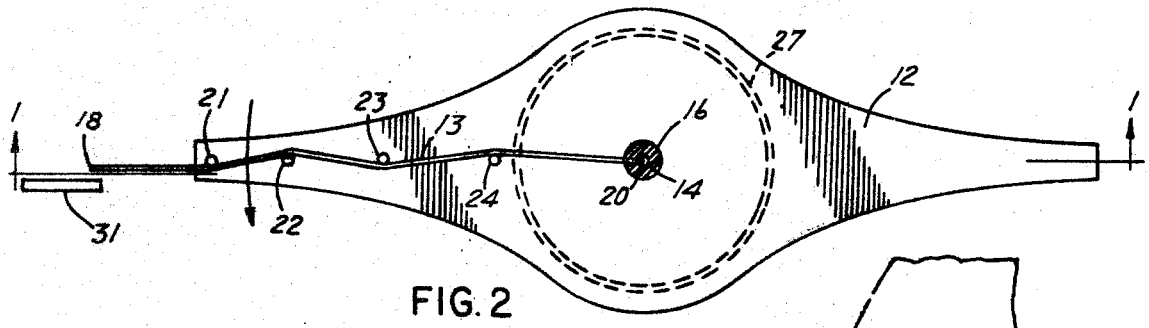
FIG. 2 is a top plan view of the filament accelerating apparatus shown in FIG. 1 with the motor and drive shaft removed to show the feed aperture in the hub.

Referring now to the drawings, the filament accelerating apparatus shown in FIGS. 1 and 2 includes a blade-like impeller or rotary member 12 with a length of filament 13 shown disposed on the top surface thereof extending through a central feed aperture 14 in the center of the rotary member at its axis of rotation 15 and beyond the end of the rotary member to terminate in a tip portion 18. The rotary member 12 has an upstanding peg-like member 21 adjacent the end or tip thereof in a center position on the longitudinal center line of the rotary member 12 providing a filament-contacting portion that moves against the side of the length of filament to apply primary or principal impelling forces upon the rotary member when the length of filament is rotated about the axis of rotation 15. Secondary impelling forces are applied by intermediate upstanding peg-like member 23, the principal function of which is to restrain the movement of the filament, as described more fully hereinafter.

The term "length of filament" as used herein refers to that portion of the filament shown extending from the axis of rotation to the outer tip of the filament which is rotated about the axis of rotation 15, and the distance from the axis of rotation along the filament to the center of the outermost peg-like member 21 is referred to herein as the "torque arm distance."

The rotary member 12 is shown as supported for rotation in a depending or hanging member on the end of a hub 16 at the lower end of a vertical drive shaft 17 driven by a prime mover 19 such as an electric motor. Electric motors used for high-speed centrifuges may be used which will develop speeds as high as in excess of 25,000 rpm. Other suitable prime movers would include a gas-driven turbine having a speed in excess of 500,000 rpm. The impelling means for rotating the filament in the form shown in FIGS. 1 and 2, then, includes the motor 19, shaft 17, hub 16, rotary member 12 and peg-like members 21 and 23 which, upon actuation of the motor, applies an impelling force to the length of filament 13 a torque arm distance from the axis of rotation to rotate the length of filament 13 about the axis of rotation 15 to develop a useful tip speed in the tip portion 18, as described more fully hereinafter. The use of a depending vertical shaft with the rotary member or impeller 12 mounted for rotation at the lower end as shown in FIG. 1 is a preferred way of providing self-balancing for the rotary member for high-speed rotation.

As best seen in FIG. 2, the hub 16 is provided with a hole 20 in communication with aperture 14 that turns out in a radial direction and is sized and smoothed or polished to permit the filament to slide freely therethrough. The specific structure defining the filament feed aperture 14, preferably, is in the form of an eyelet with smooth rounded edges to be as friction free as possible for the filament to be drawn or advanced therethrough as a result of the centrifugal forces exerted thereon during rotation.

The apparatus shown in FIGS. 1 and 2 is further constructed and arranged for providing for the controlled advancement of the filament during the application of the impelling force above described. This is provided by having the length of filament 13 rotated being the end section of a supply in the form of a coil 26 of the filament in a cylindrical support body 27 secured to the underside of the rotary member, both arranged concentric with the axis of rotation and free to unwind from the coil so that the filament will be drawn or move toward the tip under the influence of the centrifugal forces on the length of filament as a result of the application of the impelling forces causing the length of filament to rotate about the axis of rotation. Along with this feed of the filament from the coil is filament support structure which in the form shown in FIGS. 1 and 2 is a plurality of intermediate upstanding peg-like members 22, 23 and 24 arranged on the longitudinal center line between the feed aperture and the outer peg-like member 21. The filament 13 shown extends behind member 24, in front of member 23, behind member 22 and in front of member 24 in relation to the direction of rotation shown in FIG. 2. In the arrangement shown the outer peg-like member 21 also serves as a portion of the filament support structure.

The purpose of the filament support structure is to increase the filament tip speed by providing support for the length of filament extending from the axis of rotation 15 to the filament tip 18. In the embodiments having a filament support structure, part of the centrifugal force due to the rotation of the length of filament extending from the axis of rotation 15 to the filament tip 18 is borne by the filament support structure. As a result of the support provided by the filament support structure, the tension at any point in the filament between the axis of rotation and the outer peg-like member 21 is less than the tension that would be present if the filament support structure were absent. As a result of the decreased tension in the length of filament between the axis of rotation 15 and the outer peg-like member 21, the employment of a filament support structure allows a greater filament tip speed to be obtained than may be obtained if the filament support structure is lacking.

The maximum benefit is obtained when the filament support structure is arranged so that the filament tension at every point in the length of filament between the axis of rotation 15 and the outer peg-like member 21 is less than, or at most equal to, the tension in the filament at the outer peg-like member 21. In the absence of a filament support structure, the maximum filament tension due to the centrifugal force on the rotating filament occurs at the axis of rotation 15, which tends to tear the filament off at the axis of rotation. It may therefore be said that one of the functions of the filament support structure is to move the point of maximum filament tension from the axis of rotation 15 to the outer peg-like member 21, thereby increasing the filament tip speed that may be obtained.

The rotary member 12 shown in the drawings is constructed and arranged for maximum tip speeds and as shown is in the form of a relatively thin, flat surfaced (top and bottom) plate which in plan is narrower in width at the ends and gradually becomes wider along curved opposed side edges toward the center with a maximum width at the center in a double bell-like shape. In plan, the rotary impeller 12 may further be characterized as symmetrical in shape about both sides of a vertical axis and a horizontal axis through the center and axis of rotation of the rotary member. This in effect provides two back-to-back bell shapes with the minimum weight at the tips. While a single radial arm extending out from the axis of rotation can be used, the opposed arm configuration shown is preferred for balance. The shape of the rotary member shown exhibits reduced resistance during rotation.

Figure 3:
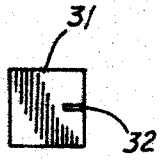
FIG. 3 is a top plan view of the workpiece shown in FIG. 1 which has been cut by the tip portion of the moving filament shown in FIGS. 1 and 2.
Figure 6:
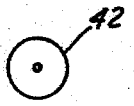
FIG. 6 is a top plan view of the filament guide shown in FIG. 5.

The apparatus shown in FIGS. 1–3 is particularly suitable for cutting a workpiece 31 positioned in the circular path circumscribed by the tip portion of the filament. The impact of the tip portion of the filament 14 cuts through the workpiece as represented at 32. In this form the frictional resistance provided by the peg-like members is selected in relation to the speed of the rotary member so that the filament is advanced a selected increment each revolution and eventually cuts the workpiece 31 in half.

Figure 4:
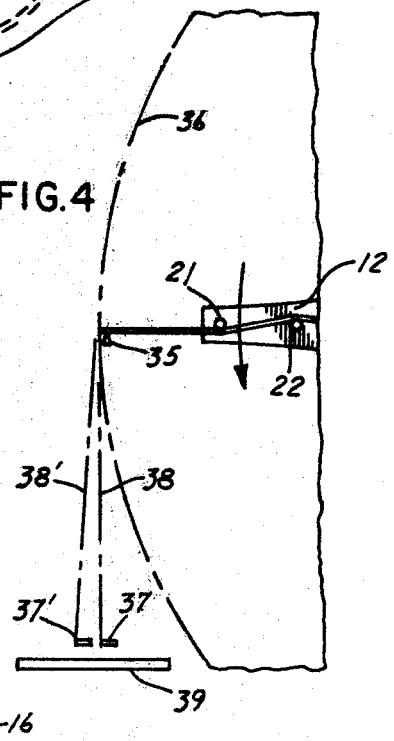
FIG. 4 is a top plan view of a portion of the filament accelerating apparatus shown in FIG. 1 with a cutting member arranged in relation to the tip portion of the rotary member and filament to cut the tip of the moving filament to produce a stream of high-speed particles.

This apparatus shown in FIGS. 1–3 is also suitable for producing a stream or succession of high-speed particles by periodically releasing the tip portion of the moving filament during the advancement thereof as by cutting at a particular point in the rotation. The additional apparatus for this operation is illustrated in FIG. 4. In FIG. 4 there is illustrated a cutting element 35 located just inside the tip of the filament against which the filament strikes as it traces a circle 36 in a plane perpendicular to the axis of rotation and is cut off as a moving particle 37 which will move approximately along a path 38 tangent to circle 36 to strike a workpiece 39. In some instances the particle 37' will not follow a true tangential line but a path 38' which is at a slight angle to the line that is tangent to circle 36. In this way a series of particles are cut from the advancing filament which may be used for performing welding, drilling, coating, cutting and like operations, depending on the selection of materials for the filament, the speed and the workpiece.

It is understood that there are several techniques that may be used to cut the filament, such as a wire oriented perpendicular to the moving filament, or the filament may be cut using laser or electric arc techniques. In practice this apparatus may be termed a filament pump which with a modest power input will produce remarkably intense, powerful bursts of kinetic energy.

The speeds attainable for accelerating the filament with the above-described apparatus are limited for the most part by the speed of the drive motor 19, the strength of the filament 13, and the strength of the rotary member 12. In practice, for the rotary member 12 shown, tip speeds that are readily attainable are, without the use of an evacuated chamber, up to one to two times the speed of sound in air or up to a tip speed of 2.5 km/sec. A lower range of tip speeds is contemplated for some applications including speeds below 1 km/sec, down to 0.1 km/sec and even as low as 0.01 km/sec.

The mathematical expressions for a moving filament may be described as follows:

Let r be the distance from the axis of rotation 15 to a point on the filament, $r_1$ be the distance from the axis of rotation to the outer peg-like member 21, $r_2$ be the distance from the axis of rotation 15 to the filament tip 18, C be the strength of the filament, A be the filament cross section, D be the density of the filament, W be the rate of rotation in radians per unit time, T be the filament tension at r, F be the filament supporting force directed toward the axis of rotation per unit length, and v be the tangential speed of the filament tip.

The differential statement of Newton's second law for a filament in the present case is $$dT + DAW^2 r dr - F dr = 0 \quad (1)$$

In the absence of a filament supporting force, F = 0. Equation (1) may be integrated, applying the boundary condition $T(r_2) = 0$, to obtain $$T = \tfrac{1}{2} DAW^2 (r_2^2 - r^2) \quad (2)$$

Tip speed of the filament is maximum for T(0) = AC. This condition may be applied to Equation (2) to obtain the maximum obtainable filament tip speed in the absence of a filament supporting force $$v = (2C/D)^{\frac{1}{2}} \quad (3)$$

If a filament supporting structure is employed, Equation (2) gives the filament tension for r greater than or equal to $r_1$. The maximum benefit is obtained when the filament supporting force is distributed so that the filament tension at any point in the length of filament between the axis of rotation and the outer peg-like member is less than or equal to the tension in the filament at the outer peg-like member.

The condition $T(r_1) = AC$ may be applied to Equation (2) to obtain the maximum obtainable filament tip speed for the condition that the filament tension is maximum at the outer peg-like member 21:

$$v = (2C/D + r_1^2)^{\frac{1}{2}} \quad (4)$$

If a filament supporting force is employed, Equation (1) may be arranged to yield the required filament supporting force in the direction of the axis of rotation per unit length:

$$F = dT/dr + DAW^2 r \quad (5)$$

By substituting an appropriate tension distribution T(r), r greater than or equal to zero but less than or equal to $r_1$, into Equation (5), the appropriate filament supporting force per unit length in the direction of the axis of rotation may be obtained.

For example, let the required filament tension in the region r greater than or equal to zero but less than or equal to $r_1$ be T = AC. This distribution of filament tension satisfies the requirement that the tension at any point in the filament between the axis of rotation and the outer peg-like member be less than or at most equal to the filament tension at the outer peg-like member. Since T is constant, dT/dr = 0, and Equation (5) reduces to $$F = DAW^2 r \quad (6)$$

In the form shown in FIGS. 1, 2, 4, 7 and 12, the filament supporting force is the result of the friction of the filament running against the peg-like members 21–24 of the filament supporting structure. If the diameter of the peg-like member is p, the coefficient of friction is f, and the distance between pegs is q, then $$q = (2pCf/W^2 r)^{\frac{1}{2}} \quad (7)$$

Referring now to Table 1 below, there are listed the maximum tip speeds for several high strength filament support and the maximum tip speeds employed in an impeller with filament support having a tip speed of 1 km/sec. Also given are the kinetic energy density, which is one-half the product of the filament density and the square of the tip speed, the kinetic energy intensity, which is the product of the kinetic energy density and the filament tip speed, the kinetic energy per unit length of filament, and the average power per unit length of filament divided by the time required for the filament to travel one diameter.

TABLE 1

| | Density g/cm³ | Breaking Strength ksi | Typical Diameter microns | Filament Tip Speed km/s | Energy Density joules/cm³ | Energy Intensity watts/cm² | Kinetic Energy joules/mm | Average Power watts/mm |
|---|---|---|---|---|---|---|---|---|
| | | | ROTARY MEMBER WITHOUT FILAMENT SUPPORT | | | | | |
| E Glass | 2.55 | 500 | 10 | 1.64 | $3.45 \times 10^3$ | $5.67 \times 10^8$ | $2.71 \times 10^{-4}$ | $4.45 \times 10^4$ |
| S Glass | 2.50 | 650 | 10 | 1.89 | $4.48 \times 10^3$ | $8.49 \times 10^8$ | $3.52 \times 10^{-4}$ | $6.66 \times 10^4$ |
| $SiO_2$ | 2.19 | 850 | 35 | 2.31 | $5.86 \times 10^3$ | $1.36 \times 10^9$ | $5.64 \times 10^{-3}$ | $3.73 \times 10^5$ |
| Carbon/Graphite (Thornel 25) | 1.50 | 350 | 5 | 1.79 | $2.41 \times 10^3$ | $4.33 \times 10^8$ | $4.74 \times 10^{-5}$ | $1.70 \times 10^4$ |

TABLE 1-continued

| | Density g/cm³ | Breaking Strength ksi | Typical Diameter microns | Filament Tip Speed km/s | Energy Density joules/cm³ | Energy Intensity watts/cm² | Kinetic Energy joules/mm | Average Power watts/mm |
|---|---|---|---|---|---|---|---|---|
| Music Spring Wire | 7.74 | 400 | 178 | 0.84 | $2.76 \times 10^3$ | $2.33 \times 10^8$ | $6.86 \times 10^{-2}$ | $3.25 \times 10^5$ |
| Tungsten | 19. | 590 | 15 | 0.65 | $4.07 \times 10^3$ | $2.66 \times 10^8$ | $7.19 \times 10^{-4}$ | $3.14 \times 10^4$ |
| ROTARY MEMBER WITH FILAMENT SUPPORT, TIP SPEED 1 km/s | | | | | | | | |
| | | | | 1.92 | $4.82 \times 10^3$ | $9.09 \times 10^8$ | $3.71 \times 10^{-4}$ | $7.14 \times 10^4$ |
| | | | | 2.14 | $5.73 \times 10^3$ | $1.23 \times 10^9$ | $4.50 \times 10^{-4}$ | $9.64 \times 10^4$ |
| | | | | 2.52 | $6.96 \times 10^3$ | $1.75 \times 10^9$ | $6.69 \times 10^{-3}$ | $4.82 \times 10^5$ |
| | | | | 2.05 | $3.16 \times 10^3$ | $6.50 \times 10^8$ | $6.21 \times 10^{-5}$ | $2.25 \times 10^4$ |
| | | | | 1.31 | $6.63 \times 10^3$ | $8.67 \times 10^8$ | $1.65 \times 10^{-1}$ | $1.21 \times 10^6$ |
| | | | | 1.20 | $1.36 \times 10^4$ | $1.62 \times 10^9$ | $2.40 \times 10^{-3}$ | $1.91 \times 10^5$ |

Figure 5:
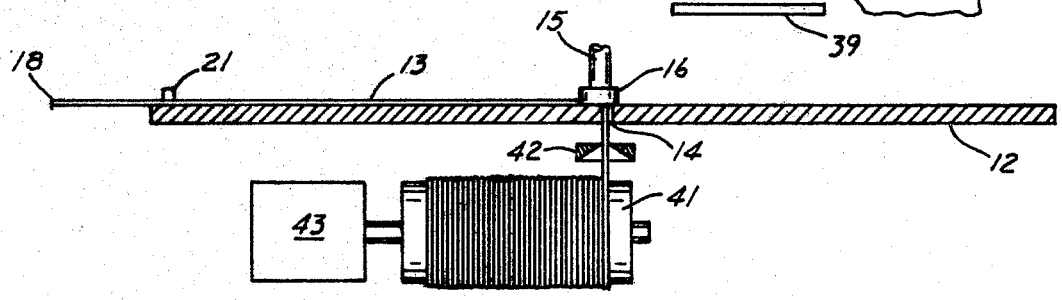
FIG. 5 is a side elevational view of another form of filament accelerating apparatus, again with the rotary member in section offset to one side of the actual longitudinal center line and with the drive motor and a portion of the drive shaft removed.

Referring now to FIG. 5, another arrangement for controlling the advancement of the filament along its length during its rotation about the axis of rotation is provided by a rotary drum or spool 41 on which a supply of the filament is wound and the filament passes through a guide 42 alined with the feed aperture 14 in the rotary member 12. A speed regulated drive motor 43 rotates the drum at a speed to pay out the filament at a selected rate. The drive and shaft for the rotary member are the same as those shown in FIGS. 1 and 2 but have been removed to save drawing space.

In yet another form of the accelerating apparatus shown in FIG. 7 there is provided a hollow cylindrical support body 46 containing a coil 47 of filament affixed between an upper section drive shaft 48 and a lower section drive shaft 49. The upper section drive shaft is coupled to the drive motor 19. The lower section drive shaft 49 is coupled between the bottom of the body and a hub 52 affixed to the top of the rotary member 12. There are further shown upper bearings 53 associated with shaft section 48 and lower bearings 54 associated with lower section drive shaft 49 whereby the rotary member 12 is supported in a dependent manner for rotation and the filament is fed through a center hole in the lower drive shaft section 49 and through a hole in the hub 52 to advance toward the tip portion of the rotary member 12. The same restraining outer intermediate peg-like members 21–24 are shown mounted on the rotary member in this form.

Figure 10:
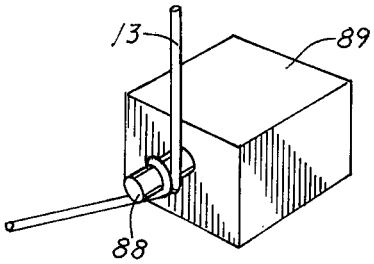
FIG. 10 is a perspective view of a drag device for controlling the advancement of the filament shown in FIG. 8.

Referring now to FIGS. 8–10, the apparatus shown therein includes the rotary member 12 contained in a hollow body 61 forming an evacuated chamber 62 whereby the rotary member and filament are rotated in an evacuated space and in this way may provide even higher tip speeds. The hollow body 61 is shown in FIG. 8 to have a top wall 64, a bottom wall 65 and an upright sidewall 66 that is somewhat circular in shape and has straight sections **66*a* and 66*b* in one quadrant meeting at a corner. The structure in the corner forms a series of vacuum chambers 67, 68 and 69, each formed by pairs of opposed walls, herein shown as four parallel spaced wall sections 71, 72, 73 and 74, each having an opening 75, 66, 77 and 78, respectively, alined with one another and arranged along the tangent line through which the particle passes to strike a workpiece 39** located outside the evacuated body.

There is further provided a passage 81 formed in part by sidewall 82 opening into the passage 62 in body 61 connected to an evacuating vacuum pump P. There are auxiliary openings 83, 84 and 85 in walls forming passages 67, 68 and 69, respectively, opening into the evacuating passage whereby the pump will reduce the pressure in the chamber 62 as well as chambers 67, 68 and 69. This arrangement then provides a series of vacuum chambers with progressively lower pressures from the outer chamber 69 to the inner chamber 67 permitting the particle 37 to pass therethrough and yet maintain a high-vacuum environment in chamber 62 considerably below atmospheric pressure. The pressure in the vacuum chamber 62 would be on the order of $10^{-4}$ Torr.

In the embodiment shown in FIGS. 8–10 there is shown yet another form of drag control for the filament therein illustrated as a drag shaft 88 rotating in a housing 89. There is a selected amount of friction on the shaft and the filament coming from the coil loops around the shaft and then through the feed aperture 15. The drag control may be adjustable to meet the requirements of the filament and speed.

Figure 11:
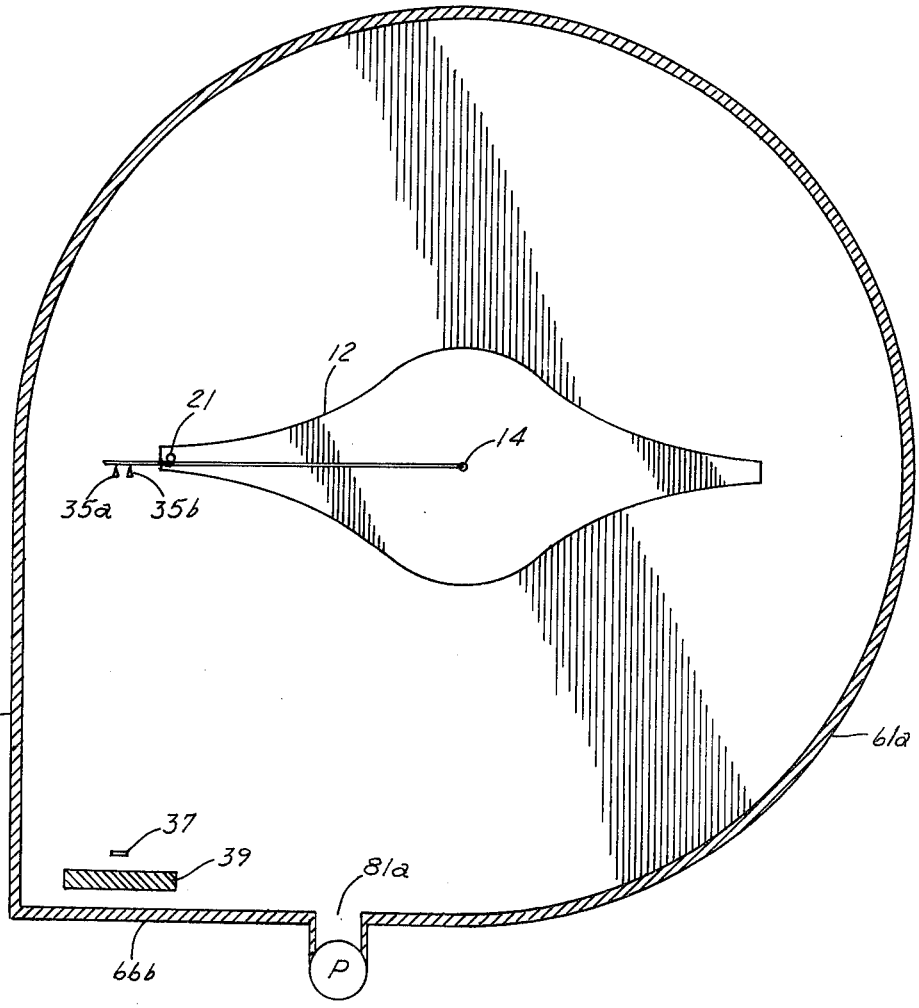
FIG. 11 is a sectional view similar to the view of FIG. 8 showing an alternative position for the workpiece.

The embodiment of FIG. 11 is essentially the same as that of FIGS. 8–10 with the exception that the workpiece against which the particles strike is located inside the chamber, thus eliminating the necessity for the succession of evacuated passages. The vacuum pump P evacuates the chamber through a passage designated **81*a***.

In a sequence of operation for the apparatus of FIGS. 8 and 9, the chambers 67, 68 and 69 are evacuated to a relatively low pressure by pump P. Since chamber 69 is open to the atmosphere via aperture 78, it has more pressure than chamber 68, which in turn has more pressure than chamber 67, as above discussed. Upon actuation of motor 19 and the associated shaft, the rotary member 12 is rotated to develop a selected tip speed in the filament 13. The tip portion 18 of the filament strikes the cutting blades **35*a* and 35*b* which are arranged so that the particle 37 flies through openings 75, 76 and 77 and against the workpiece 39**.

In the alternative form shown in FIG. 11 the workpiece is inside the evacuated chamber 62 and no auxiliary evacuated chambers are required. As the rotary member 12 is rotated the coil unwinds at a speed related to the speed of the rotor and controlled by the drag on shaft 88 to advance the filament so as to control the size of the particle. The speed of the spool is adjusted by setting the drag on shaft 88. It is further understood that the feed of the coil may be in steps using a ratchet-like advance turned with the revolutions of the rotary member. As an alternative to the blades **35*a* and 35*b***, a laser beam or the like may be used to cut off the tip of the radially advancing filament.

Figure 12:
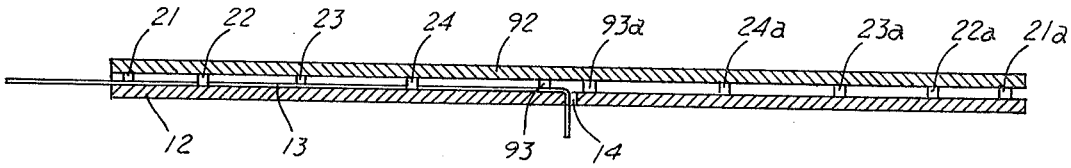
FIG. 12 is a vertical sectional view, again offset slightly from the longitudinal center line, of another form of ultra-high speed rotary member usable in the evacuated chambers shown in FIGS. 8–11.

In the embodiment shown in FIG. 12 there is shown a modified rotary member whereby the same rotary member 12 is employed with the same peg-like members 21, 22, 23 and 24 and the center feed aperture 25 through which the filament is fed. In this form an upper rotary member 92 of the same size and shape as rotary member 12 is provided and an additional peg-like member 93 is provided adjacent the aperture and in line with members 21, 22, 23 and 24. More offsetting peg-like members **21*a*, 22*a*, 23*a*, 24*a* and 93*a*** are provided to have a balanced rotary member. This construction ensures that the peg-like members will not be released during high-speed rotation.

The embodiments with the rotary member enclosed may contain a light gas atmosphere such as helium or hydrogen for reduced drag or friction for the high speed elements.

From the foregoing, and with particular reference to the filament materials and speeds listed, it is apparent that in accordance with the present invention there is provided a highly effective way of producing a rapid stream of ultra-high velocity micron-size particles. The term "ultra-high velocity" as used herein would be in the range of about 0.01 to 100 km/sec and micron-size in the range of about 1 to 1000 microns. Filament materials of a high strength of between 100 and 1000 ksi are preferred for some applications. The evacuated space preferably would be up to $10^{-4}$ Torr.

Although the present invention has been described with a certain degree of particularity, it is understood that the present disclosure has been made by way of example and that changes in details of structure may be made without departing from the spirit thereof.

What is claimed is:

1. In a filament accelerating apparatus the combination comprising:

impelling means for applying an impelling force to a length of filament having a tip portion a torque arm distance from an axis of rotation to rotate said length of filament about said axis of rotation to develop a selected tip speed in said tip portion; and means providing for the controlled advancement of said length of filament along its longitudinal axis toward said tip portion during the application of said impelling force, said length of filament being the end section of a supply of filament movable toward said tip portion under the influence of centrifugal forces on the length of filament resulting from the application of said impelling forces and including supporting means including surfaces disposed at a location departing from a radial line of the torque arm movable with said impelling means against which said length of filament moves during advancement for reducing the tension in said length of filament caused by the centrifugal forces on said length of filament for increased filament tip speed.

2. In a filament accelerating apparatus as set forth in claim 1 wherein said impelling means includes a rotary member having a central filament feed aperture at said axis of rotation through which said length of filament extends, and at least a filament-contacting portion adjacent a free end of said rotary member that moves against the side of the length of filament to apply said impelling forces to the length of filament upon the rotation of said rotary member to rotate said length of filament about said axis of rotation.

3. In a filament accelerating apparatus as set forth in claim 2 wherein said rotary member is relatively thin and flat-sided and is narrower in width at the ends and gradually becomes wider toward the center and has a maximum width at the center.

4. In a filament accelerating apparatus as set forth in claim 3 wherein the opposite side edges of said rotary member follow a curve to provide substantially a double bell-like shape as viewed in plan.

5. In a filament accelerating apparatus as set forth in claim 2 wherein said rotary member is suspended in a depending manner from a vertical drive shaft.

6. In a filament accelerating apparatus as set forth in claim 5 including a support body for a coil of the filament mounted under said rotary member with the filament feeding upwardly through the center feed aperture.

7. In a filament accelerating apparatus as set forth in claim 5 including a support body for a coil of the filament mounted between an upper drive shaft section and a lower drive shaft section with the filament feeding from the coil through an aperture in the lower drive shaft section to the rotary member.

8. In a filament accelerating apparatus as set forth in claim 1 wherein said supporting surfaces define a generally sinuous path for said length of filament.

9. In a filament accelerating apparatus as set forth in claim 1 wherein said filament supporting means includes a plurality of upstanding peg-like members mounted on said rotary member along a longitudinal center line and at spaced intervals with said length of filament extending alternately along one side of one and along the opposite side of the next of said peg-like members.

10. In a filament accelerating apparatus as set forth in claim 9 including an upstanding peg-like member at the tip of said rotary member applying the primary impelling force against the length of filament while each alternating of said plurality of peg-like members applies secondary impelling forces.

11. In a filament accelerating apparatus as set forth in claim 1 having filament movement restraining means including a rotary drum on which the filament is wound, said filament feeding through a feed aperture in the rotary member, and a speed-controlled drive for paying out the filament from the drum at a selected rate.

12. In a filament accelerating apparatus as set forth in claim 1 having filament movement restraining means including a shaft about which the filament from a supply is looped, said shaft having a selected drag.

13. In a filament accelerating apparatus the combination comprising:

impelling means for applying an impelling force to a length of filament having a tip portion a torque arm distance from an axis of rotation to rotate said length of filament about said axis of rotation to develop a selected tip speed in said tip portion; and means providing for the controlled advancement of said length of filament along its longitudinal axis toward said tip portion during the application of said impelling force, said impelling means and length of filament being enclosed in a housing defining an evacuated chamber, and means for evacuating said chamber.

14. In a filament accelerating apparatus as set forth in claim 13 wherein said impelling means includes a rotary member having an upper section and a lower section of a corresponding size and shape, said upper and lower sections being joined by a plurality of peg-like members arranged along a longitudinal center line at spaced intervals, the number and spacing of peg-like members on each side of the center being the same for balance, there being a filament feed aperture at the center of one of said upper and lower sections.

15. A method of accelerating a filament comprising the steps of:

applying an impelling force to a length of filament having a tip portion a torque arm distance from an axis of rotation to rotate said length of filament about said axis of rotation to develop a selected tip speed in the tip portion of said length of filament causing said length of filament to depart from a radial line of the torque arm by movement against supporting surfaces for reducing the tension in said length of filament caused by the centrifugal forces on said length of filament for increased filament tip speed; and simultaneously advancing said length of filament along its longitudinal axis toward said tip portion during the application of said impelling force.

16. A method as set forth in claim 15 wherein said application and advancing of said length of filament is in an evacuated space.

17. A method as set forth in claim 15 wherein said filament develops a tip speed in the range of about 0.01 kg/sec to 2.5 km/sec.

18. A method as set forth in claim 15 wherein said filament is moved in a light gas atmosphere for reduced drag.

* * * * *

UNITED STATES PATENT AND TRADEMARK OFFICE

CERTIFICATE OF CORRECTION

PATENT NO. : 4,131,045

DATED : December 26, 1978

INVENTOR(S) : Dennis R. Peterson

It is certified that error appears in the above-identified patent and that said Letters Patent are hereby corrected as shown below:

Claim 17, line 3, change "kg/sec" to --km/sec-- (first occurrence)

Signed and Sealed this

*First* Day of *May 1979*

[SEAL]

*Attest:*

RUTH C. MASON
*Attesting Officer*

DONALD W. BANNER
*Commissioner of Patents and Trademarks*